United States Patent [19]

Hashimoto et al.

[11] Patent Number: 4,686,967

[45] Date of Patent: Aug. 18, 1987

[54] ROCKING MASSAGE CHAIR

[75] Inventors: Koichi Hashimoto, Sakata; Haruo Sugai, Hikone; Hikoyoshi Hara, Shijonawate; Norio Yamada, Hikone, all of Japan

[73] Assignee: Matsushita Electric Works, Ltd., Osaka, Japan

[21] Appl. No.: 799,979

[22] Filed: Nov. 20, 1985

[30] Foreign Application Priority Data

Dec. 19, 1984 [JP] Japan ..... 59-269300

[51] Int. Cl.[4] ..... A61H 15/00

[52] U.S. Cl. ..... 128/57; 128/52

[58] Field of Search ..... 128/57, 52

[56] References Cited

U.S. PATENT DOCUMENTS

| | | | |
|---|---|---|---|
| 3,664,333 | 5/1972 | Hill | 128/52 |
| 3,736,920 | 6/1973 | Mathers et al. | 128/57 |
| 4,085,738 | 4/1978 | Kodena | 128/52 |
| 4,149,531 | 4/1979 | Tanaka et al. | 128/52 |
| 4,190,043 | 2/1980 | Thompson | 128/52 |
| 4,422,448 | 12/1983 | Sagai et al. | 128/57 |
| 4,458,675 | 7/1984 | Nakao et al. | 128/52 |
| 4,574,786 | 3/1986 | Hashimoto e al. | 128/52 |

FOREIGN PATENT DOCUMENTS

| | | | |
|---|---|---|---|
| 3429392 | 2/1986 | Fed. Rep. of Germany | 128/57 |
| 142538 | 3/1982 | Japan . | |
| 2123298 | 2/1984 | United Kingdom | 128/57 |

*Primary Examiner*—Edgar S. Burr
*Assistant Examiner*—Tonya Lamb
*Attorney, Agent, or Firm*—Burns, Doane, Swecker & Mathis

[57] ABSTRACT

A rocking massage chair wherein massaging wheel elements and their drive mechanism are disposed in backrest part of the chair while a motor for driving an operating shaft of the drive mechanism is disposed in seating part of the chair, whereby the relatively heavy motor is located on forward side of a rocking center of the chair so as to keep the center of gravity of the chair always on the forward side and thus to prevent the chair from overturning rearward.

8 Claims, 13 Drawing Figures

ROCKING MASSAGE CHAIR

This invention relates to rocking massage chairs and, more particularly, to massagers in the form of rocking chair in which massaging wheel elements are assembled in the backrest of the chair for rotation and vertical shifts.

The rocking massage chair of the type referred to allows the user sitting in the chair and even rocking the chair to exercise desired massaging operation with respect to his back at any desired position, and is useful because the user can massage himself while comfortably leaning against the backrest.

DISCLOSURE OF PRIOR ART

There has been suggested, for example, by M. INADA such a rocking massage chair as in Japanese Utility Model Appln. Laid-Open Publication No. 142538/1982, in which the massaging wheel elements, their drive mechanism and a motor as a driving source are housed within a backrest part of the chair so that the motor and drive mechanism can provide rotational or vertically shifting movement or both to the massaging wheel elements for their proper massaging operation.

According to this known device, however, dispositions of the massaging wheel elements, their drive mechanism and motor which are all heavy constituent parts are concentrative to the backrest part, and there is involved such a risk that, when the user sitting in the massage chair gives a relatively large rocking movement to the chair, the chair may happen to turn over backward. The particular risk may well be removed by designing rocking legs of the massage chair to be small in curvature and large in length at their part engaging the floor, but this measure eventually causes a sufficient rocking function of the chair to be lost. That is, the measure has been rather defective in deteriorating the inherent function of the rocking chair, rendering the user not allowed to comfortably lean against the backrest so as not to obtain a favourable massaging effect, and requiring a large occupation area. As another measure, a counterweight may be secured to a front part of the seat or rocking leg part of the massaging chair for eliminating the risk, but this still causes such other problems to arise that the overall weight of the chair becomes large enough for rendering the chair to be uneasy to move, and manufacturing cost becomes high.

TECHNICAL FIELD OF THE INVENTION

A primary object of the present invention is, therefore, to provide a rocking massage chair which allows the inherent rocking movement of the chair to be well achieved and also the user to reliably lean his body against the backrest of the chair with full weight for enhancing a favourable massaging effect, while avoiding any increase in the weight of the chair and in its manufacturing cost.

This object of the present invention is realized by providing a rocking massage chair which comprises a rocking chair body including integral backrest and seating parts and a lower base having an arcuate bottomed part, the chair body accomodating therein massaging wheel elements, drive mechanism including a driving shaft for the elements, and driving motor for the shaft, the massaging wheel elements being provided in the backrest part for rotation and vertical shifts as driven through the mechanism by the motor, wherein the arcuate bottomed part of the base is positioned at an area expanding immediately behind a junction of the backrest and seating parts and vicinity thereof, the massaging wheel elements and drive mechanism are disposed in the backrest part, and the driving motor is disposed in the base to be beneath the seating part.

With such arrangement of the present invention, in particular, the relatively heavy driving motor is located on forward side of the rocking center of the chair body upon its rocking motion, to add the weight of the motor to the forward side, whereby the chair can be prevented from turning over backward so that the user sitting in the chair body can lean his body weight reliably against the backrest part for fully receiving massaging force through the massaging wheel elements and optimum massaging action.

Other objects and advantages of the present invention shall become clear from the following description of the invention detailed with reference to a preferred embodiment shown in accompanying drawings.

Figure 1:
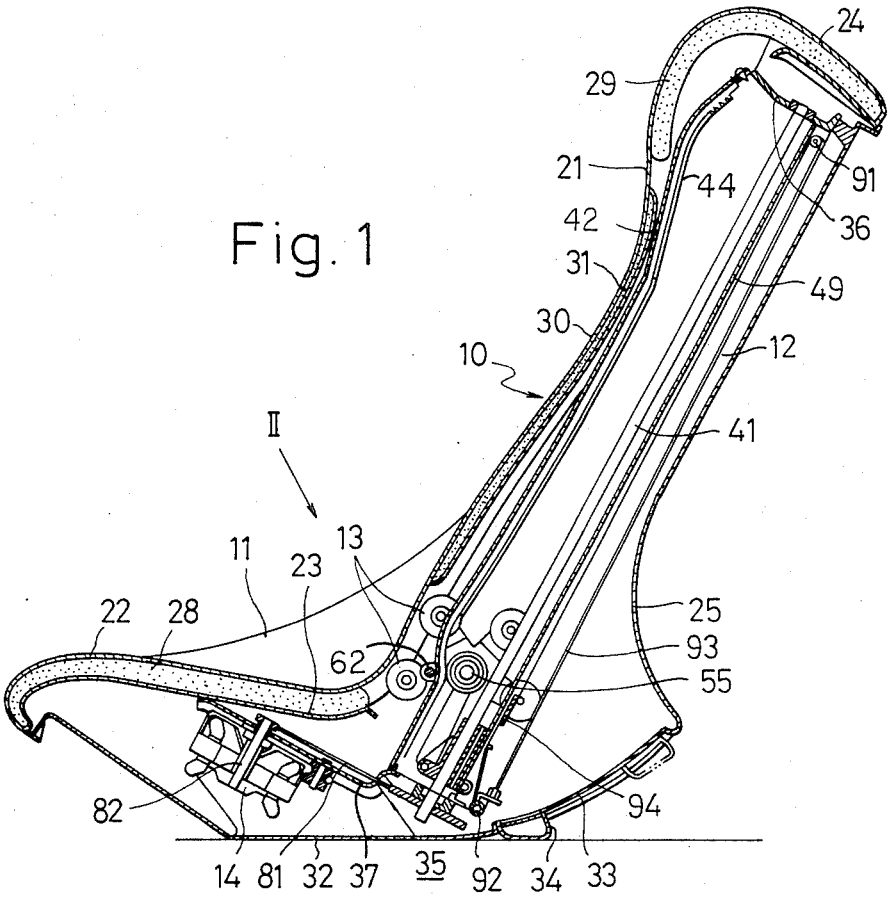
FIG. 1 is a vertical sectional view of a rocking massage chair according to the present invention, taken along the central vertical plane thereof.

While the present invention shall now be described with reference to the preferred embodiment shown in the drawings, it should be understood that the intention is not to limit the invention only to the particular embodiment shown but rather to cover all alterations, modifications and equivalent arrangements possible within the scope of appended claims.

DISCLOSURE OF PREFERRED EMBODIMENT

Figure 2:
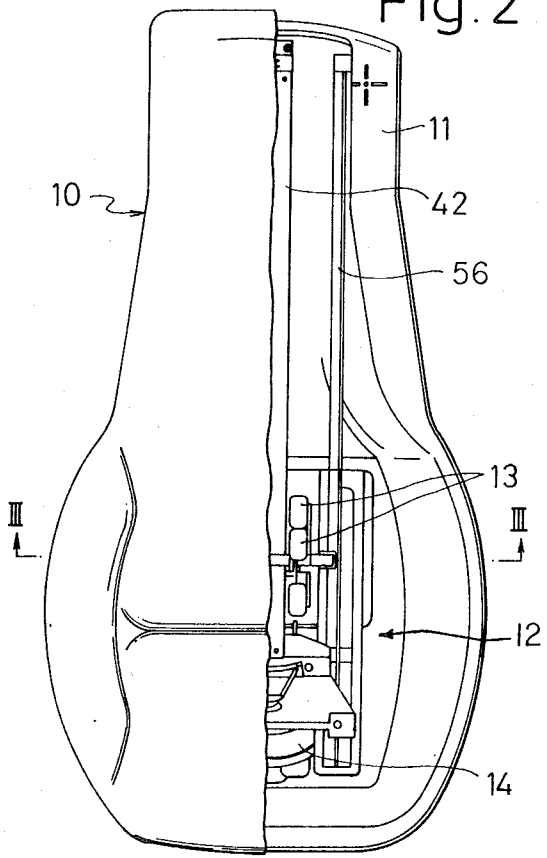
FIG. 2 is a frontal plan view of the chair as seen in a direction shown by an arrow II in FIG. 1, with half of cover sheet removed for partly showing the interior arrangement of the chair.

Referring to FIGS. 1 to 3, a rocking massage chair 10 according to the present invention generally comprises a chair body 11 forming substantially the rocking chair, a drive mechanism 12, massaging wheel elements 13 driven by the mechanism 12 for rotation or vertical shifts or both, and a driving motor 14 coupled to the driving mechanism 12 for providing a drive power to the mechanism.

The chair body 11 comprises a backrest part 21 and a seating part 22 which are integral with each other, while the backrest part 21 is extended diagonally upward and backward from the seating part 21 which extends substantially horizontally forward, and preferably the body 11 is formed in a bucket seat as a whole. In the illustrated embodiment, the chair body 11 includes a main frame which provides basic contour of the general bucket seat and is preferably made of a plastic. The main frame comprises a front side frame 23 extending from the backrest part 21 including its headrest 24 to the seating part 22, and a rear side frame 25 spaced from the front side frame 23 to define between them a space for accommodation of the drive mechanism 12, wheel elements 13 and motor 14, while the both frames 23 and 25 are coupled to each other by a suitable means.

The front side frame 23 is provided, in a zone corresponding to the backrest part 21, with a vertically extended opening 26 of a configuration allowing the massaging wheel elements 13 driven by the drive mechanism 12 to project out of the frame, on both sides of the opening 26, with cushions 27 and 27*a* to form both side parts of the backrest part 21 and, substantially entirely over a zone corresponding to the seating part 22, with a cushion 28. Further, a cushion 29 is provided over the top zone corresponding to the headrest 24 of the front side frame 23. With such provisions of the cushions 27, 27*a* and 28 and 29, the user who sits in the chair body 11 can have a soft and comfortable touch at the cushions 27 and 27*a* with side portions of his body and with elbows, at the cushion 28 with portions from his lower waist to the upper legs, and at the cushion 29 with his rear neck and head portions. In the present instance, further, the front side frame 23 is covered, entirely over the cushions 27, 27*a*, 28 and 29, by a cover sheet 30 made of a cloth, vinyl or the like, and this sheet is backed by a further cushion 31 at a zone corresponding to the vertically extended central part of the opening 26.

On the other hand, the rear side frame 25 includes, at its lower part forming the base part of the chair 10, a flat bottomed portion 32 and an arcuate bottomed portion 33 continuous to the flat bottomed portion 32, and the both portions 32 and 33 continuously expand from a forward position below the seating part 22 through its junction with the backrest part 21 to a position shortly above the junction, covering thus an area immediately behind the junction and vicinity thereof, as best seen in FIG. 1. The arcuate bottomed portion 33 is provided on the bottom with an adjustable rocking stopper 34 made slidable along substantially the entire length of the portion 33 so that, when the stopper 34 is slid to the lowermost position for engagement with a floor surface 35 of the like, the chair will rest stable with the entire flat bottomed portion 32 engaged with the floor surface 35 and the stopper 34 will keep the chair not rockable. As the stopper 34 is slid upward, the chair is made rockable and its rocking degree is made variable depending on the position of the stopper 34.

The chair body 11 further includes a top supporting frame 36 in the vicinity of the top of the backrest part 21 and a bottom supporting frame 37 in the vicinity of the junction between the backrest and seat parts 21 and 22, and these frames 36 and 37 are suitably coupled to the main frame. Disposed between the top and bottom supporting frames 36 and 37 is the drive mechanism 12 which carries the massaging wheel elements 13 for rotation and upward and downward shift along the backrest part 21 of the chair body 11. The bottom supporting frame 37 is sufficiently extended to reach a position immediately below the seating part 22, and the driving motor 14 which is relatively heavy is mounted to the lower side surface of the extended part of the frame 37. In this case, the mounting position of the motor 14 is made to be on the forward side of the rocking center of the chair made rockable with the stopper 34 moved upward along the arcuate bottom of the base portion 33 so that, even when the stopper 34 is located at, for example, the uppermost postion, the center of gravity of the chair body 11 will remain sufficiently on the forward side and the chair will be prevented from being turned over rearward.

Figure 10:
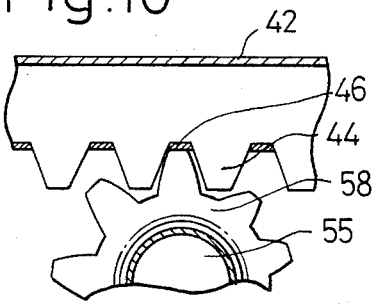
FIG. 10 is an explanatory view for showing meshing state of the rack member of the guide rail with a driving gear mounted on the unit shaft in FIG. 6.
Figure 6:
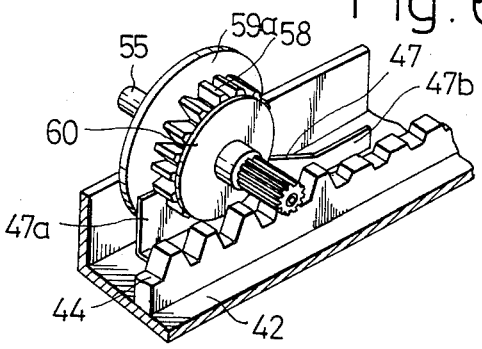
FIG. 6 is a fragmentary perspective view showing the relationship between top part of a guide rail including a rack member and its associated members mounted on the unit shaft in the drive mechanism of the chair of FIG. 1.
Figure 7:
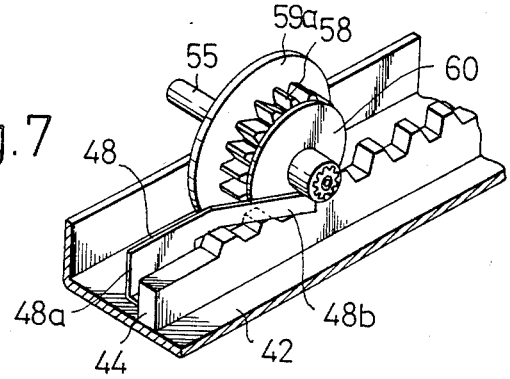
FIG. 7 is a fragmentary perspective view of lower part of the guide rail of FIG. 6.
Figure 8A:
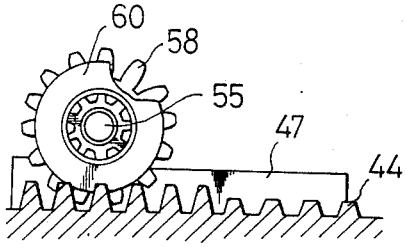
FIG. 8A and 8B are diagrams for explaining operational relationship between the rack member of the guide rail and the associated members in FIG. 6.
Figure 8B:
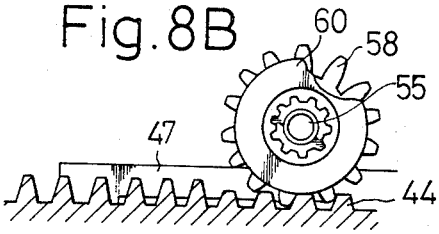

The drive mechanism 12 includes a driving shaft 41 and a guide rail 42 which are held at their both longitudinal ends to the top and bottom supporting frames 36 and 37 to be substantially mutually in parallel and front-and-rear positional relationship. In this embodiment, the driving shaft 41 is threaded on the periphery to constitute a so-called feed screw, which is axially rotatably journalled across the supporting frames 36 and 37 through proper bearings or the like. The guide rail 42 is U-shaped in section and is curved in side elevation to approach the cover sheet 30 at the upper part but to separate therefrom at the lower part. Both leg parts 43 and 43*a* of the U-shaped rail 42 are directed rearward, and a rack member 44 is fixed to the inner surface of the base wall 42*a* of the guide rail 42 to be disposed between the leg parts 43 and 43*a* to face the driving shaft 41 and extend substantially over the entire length of the guide rail. In the present instance, as seen best in FIGS. 8 through 10, the rack member 44 comprises a pair of parallel rack pieces 45 and 45*a* and, preferably, a resilient member 46 interposed between the rack pieces 45 and 45*a*. This resilient member 46 is made slightly higher than the deepest level of the rack gear so that, when the rack member 44 meshes with a driving gear of a movable unit which are explained later, a frictional contacting force between the rack member and the driving gear can be increased. At the upper end of the guide rail 42, as shown in FIG. 6, a meshing piece 47 is fixed to the inner surface of the rail, and this meshing piece 47 has a body part 47*a* spaced from the rack member 44 and a free-end part 47*b* extended and gradually approaching the rack member 44, so as to act as a means for displacing the later described driving gear of the movable unit, while the height of gears of the rack member 44 is reduced at a portion opposing the free-end part 47*b* to allow an also later described auxiliary disc of the movable unit to pass over the gears. At the lower end of the guide rail 42, on the other hand, as shown in FIG. 7, a disengaging piece 48 is fixed also to the inner surface of the rail, and this disengaging piece 48 has a body part 48*a* substantially abutting one side face of the rack member 44 and a free-end part 48*b* extended over the rack member 44 to the opposite side thereof, so as to act as a means for displacing the later described driving gear of the movable unit. The height of the rack gears is also reduced at a portion opposing the free-end part 48*b* so as to also allow the auxiliary disc of the movable unit to pass over the rack gears which are omitted at the lowermost end part of the rack member 44.

Figure 4:
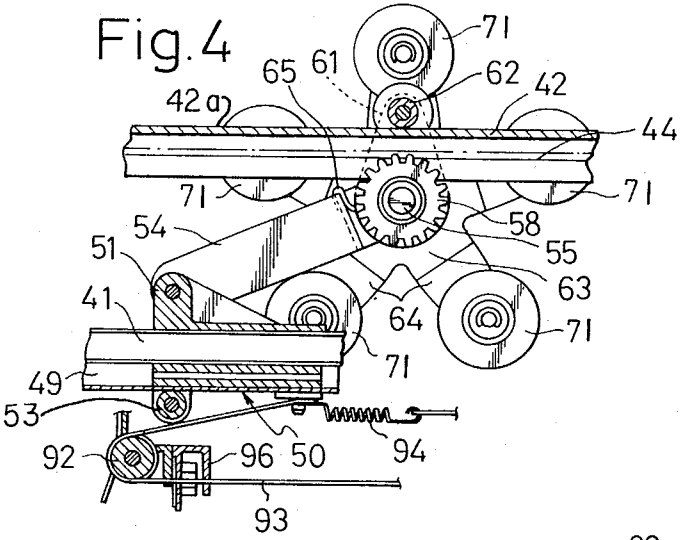
FIG. 4 is a fragmentary side elevation of a movable unit including the massaging wheel elements and their drive mechanism in the chair of FIG. 1, for showing partly in section interlocking relationship of certain members in the mechanism with the movable unit.

The drive mechanism 12 includes an auxiliary rail 49 and a movable unit 50. The auxiliary rail 49 is U-shaped in section and fixed at both longitudinal ends to the upper and lower supporting frames 36 and 37 of the backrest part 21, as disposed to enclose the driving shaft 41 from its rear side to have both leg parts of the U-shaped rail 49 parallel with, and opposed to, the guide rail 42, as seen in FIGS. 1 and 3. On the other hand, as seen in FIGS. 3 and 4, the movable unit 50 includes a feed nut block 51 fitted about the driving shaft 41 and having a pair of parallel arms 52 and 52*a* rearward extended as slightly spaced from both side surface of the auxiliary rail 49, and a roller 53 is born across extended ends of these arms 52 and 52*a* to be rollable along the rear surface of the auxiliary rail 49. The nut block 51 carries a pair of forward extended arms 54 and 54*a* pivoted at their one end to the block 51, and an axially rotatable unit shaft 55 is passed through the other extended ends of these arms 54 and 54*a*. Both ends of this unit shaft 55 extend past the arms 54 and 54*a* and carry guide rolls 57 and 57*a* which are positioned to oppose, normally through a small clearance, lateral guide surfaces 56 and 56*a* defined on the inner surface of the rear frame 25. Those guide surfaces 56, 56*a* straddle the guide rail 42.

A driving gear 58 is spline or key coupled to the central part of the unit shaft 55 to be rotatable with the unit shaft 55 but to be shiftable in the axial direction of the shaft 55. Also to the central part of the unit shaft 55, a pair of guide discs 59 and 59*a* are secured to have the driving gear 58 disposed between them, so that the discs 59 and 59*a* will rollingly slide along the inner surfaces of the leg parts 43 and 43*a* of the guide rail 42 with rotation of the unit shaft 55. The driving gear 58 shiftable on the unit shaft 55 between the guide discs 59 and 59*a* can take two positions, at one of which positions the gear 58 is in mesh with the rack member 44 on the guide rail 42 (FIG. 3A) and at the other of which the gear 58 is out of mesh with the rack member 44 (FIG. 3B). The driving gear 58 is provided with an auxiliary disc 60 on the side opposite to one of the guide discs, 59*a*, so that, when the driving gear 58 is in mesh with the rack member 44, the auxiliary disc 60 will be shiftable along one side surface of the gears of the rack member 44 opposite to that of the guide disc 59*a*, so as to prevent the driving gear 58 from being disengaged from the rack member 44.

Figure 5:
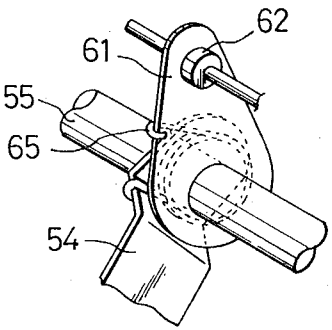
FIG. 5 is a fragmentary perspective view showing the relationship between a unit shaft and torsion spring in the movable unit of FIG. 4.

Mounted further on the unit shaft 55 through a bearing are a pair of guide plates 61 and 61*a* disposed outside the guide discs 59 and 59*a*, which plates 61 and 61*a* are extended forward closely along the leg parts 43 and 43*a* of the guide rail 42, and a roller 62 is born across the both forward extended ends of the guide plates 61 and 61*a* to be rollable along the front surface of the guide rail 42. Further on the outer sides of the guide plates 61 and 61*a*, the unit shaft 55 carries a pair of radially branched plates 63 and 63*a* respectively having, for example, five arms 64 or 64*a* radially extending as substantially equally spaced and as bent to be L-shaped in section, for holding the massaging wheel elements 13. Torsion springs 65 and 65*a* are mounted on the shaft 55 respectively between the guide plates 61, 61*a* and the arms 54, 54*a* as engaged at their one end to each of the arms 54 and 54*a* and at the other end to each of the guide plates 61 and 61*a*, so as to always urge the unit shaft 55 toward the side of the guide rail 42, to bring the driving gear 58 into mesh with the rack member 44 without any play (FIGS. 4 and 5).

The massaging wheel elements 13 comprise, for example, five pairs 71 and 71*a* of massaging wheels supported respectively on the inner side of the tip end of the respective L-shaped radial arms 64 and 64*a* by means of pins 72, 72*a* and bearings 73, 73*a* to be freely rotatable thereabout, while pushing against the cover sheet 30 through the opening 26 in the backrest part 21.

The drive motor 14 is fixed, preferably through a resilient material, to the lower surface of the extended end part of the lower supporting frame 37 by means of screws, and a driving belt 81 is hung between pulleys secured respectively to the lower end of the driving shaft 41 and an output shaft 82 of the motor 14. In order to rotate the shaft 41 in either direction, the drive motor 14 is of a reversible type, so as to be selectively reversed in its rotating direction under a control of means for detecting positions of the massaging wheels as will be detailed later, or a command signal from a controller (not shown) installed on the chair body and operated by the user, for providing a forward or backward rotational torque to the driving shaft 41 depending on the rotational direction of the motor 14.

Figure 11:
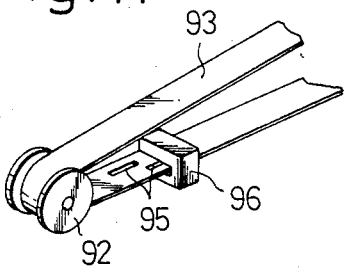
FIG. 11 is a partial perspective view of means for detecting positions of the massaging wheel elements in the chair of FIG. 1.

The means for detecting the position of the massaging wheels comprises, as seen in FIGS. 1, 4 and 11, upper and lower pulleys 91 and 92 mounted respectively on the upper and lower supporting frames 36 and 37, a detection belt 93 hung between the pulleys 91 and 92, the belt being operatively connected through a tension spring 94 to the movable unit 50 and provided therein with through holes 95 at proper positions, and a plurality of detectors 96 opposed to the belt at such positions that are close to the both pulleys for sensing the holes 95 passing the positions by, for example, an optical means as the movable unit 50 is driven to shift. When the movable unit 50 reaches a predetermined position, the detector 96 provides a signal denoting a rotational direction to the drive motor 14.

The operation and effect of the rocking massage chair according to the present invention shall now be summarized. When the drive motor 14 is actuated, the driving shaft 41 is rotated in normal or reverse direction according to the rotational direction of the motor 14, whereby the feed nut block 51 of the movable unit 50 fitted on the driving shaft 41 is caused to shift upward or downward together with the unit shaft 55 and massaging-wheel holding plates 63 and 63*a* coupled to the block 51 through the arms 54 and 54*a* pivoted thereto. As a result, the massaging wheels 71 and 71*a* on the holding plates 63 and 63*a* are moved upward or downward in the longitudinally extending opening 26 of the backrest part 21, while pressing forward the cover sheet 30. When the user is sitting in the chair body 11 and leaning his body against the backrest part 21, his weight will be applied to the massaging elements 13 and the chair body 11 will be put in its normal mode so that two pairs of massaging wheels 71 and 71*a* bearing against his back will move so as to rub his back and realize a rubbing massage.

Figure 3A:
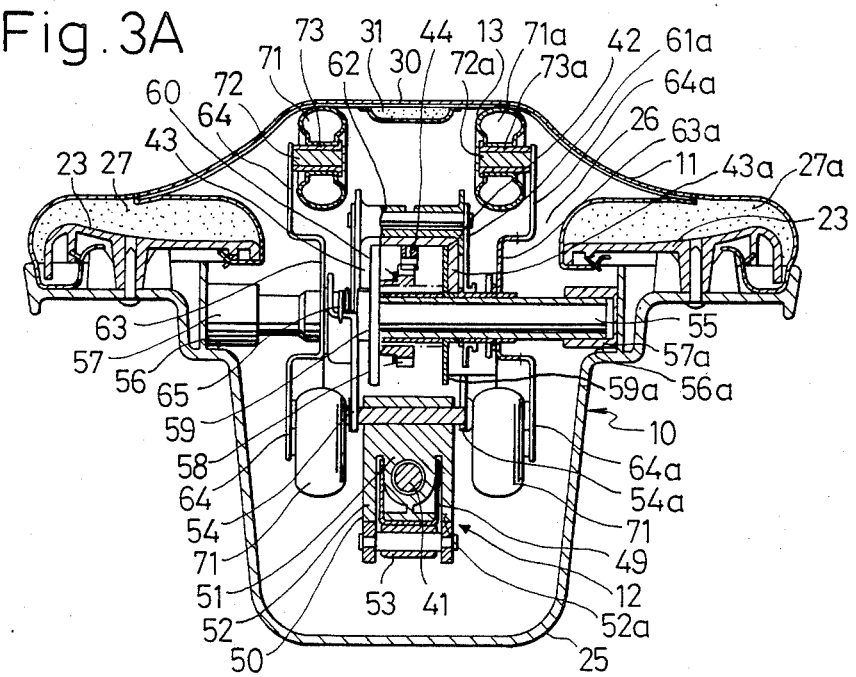
FIG. 3A is a cross sectional view of the chair taken along line III—III in FIG. 2, showing details of massaging wheel elements and their drive mechanism.
Figure 3B:
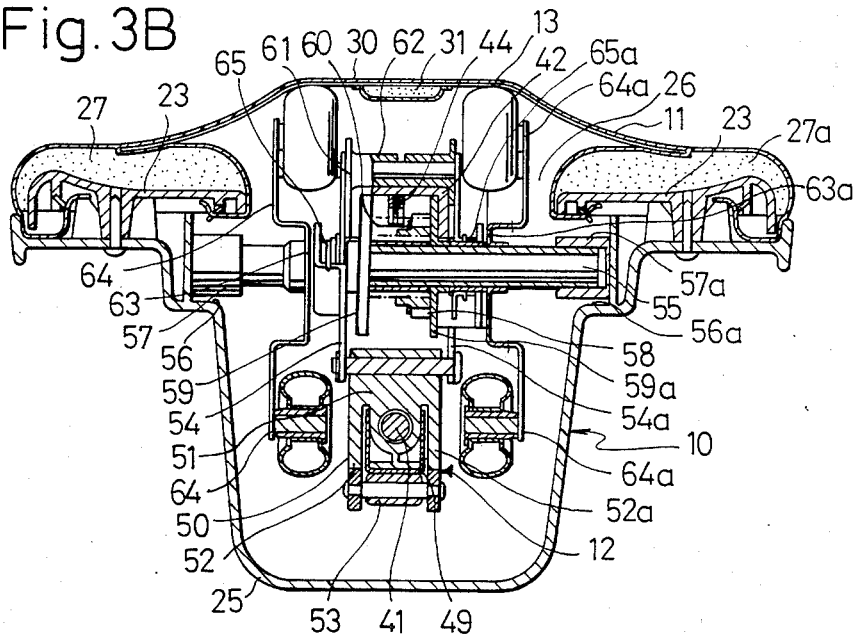
FIG. 3B is a cross sectional view similar to FIG. 3A, but with the massaging wheel elements shown at their different operational position from FIG. 3A.

When the driving gear 58, for example, spline-coupled to the unit shaft 55 is shifted to the position where the gear 58 meshes with the rack member 44 as shown in FIG. 3A, the upward or downward movement of the movable unit 50 will cause the gear 58 and shaft 55 and eventually the massaging-wheel holding plates 63 and 63*a* to be rotated, and the respective pairs of the massaging wheels 71 and 71*a* on the respective pairs of arms 64, 64*a* of the holding plates 63 and 63*a* are caused to be sequentially paid out forward, so as to repeat pressing massages with the respective pairs of massaging wheels simultaneously or alternately engaged to the user's back, whereby a variety of pressing massages can be applied to the user's back.

Figure 9:
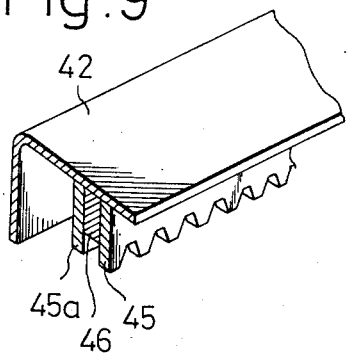
FIG. 9 is a fragmentary perspective view of the guide rail and its rack member of FIG. 6.

The mesh of the driving gear 58 with the rack member 44 can be realized, in the present embodiment, by means of the meshing piece 47 on the rack member 44 in such that, when the movable unit 50 is moved nearly to the uppermost position, the meshing piece 47 arranged to gradually approach the rack member 44 causes the driving gear 58 in its non-meshed state to be shifted onto the rack member 44, as seen in FIG. 6. During downward shift of the driving gear 58 meshing with the rack member 44, the auxiliary disc 60 which moves along the gears of the rack member 44 prevents the driving gear 58 from being disengaged from the rack member 44. As the rack member 44 comprises the pair of rack pieces 45 and 45*a* with the resilient member 46 interposed between them in such arrangement as shown in FIG. 9, the frictional force between the rack member 44 and the driving gear 58 is effectively increased to restrain any unfavourable fast rotation of the gear 58. A non-meshing state, on the other hand, of the gear 58 with the rack member 44 can be realized by means of the disengaging piece 48 such that, when the movable unit 50 is moved almost to the lowermost position, the disengaging piece 48 extended over the rack member 44 causes the gear 58 and auxiliary disc 60 to be moved sideward and disengaged from the rack member 44. When the upward or downward shift of the movable unit 50 is halted before reaching the meshing piece 47 or disengaging piece 48 and is reversed, the driving gear will be kept in the previous state. In this connection, it will be appreciated that the reversing control or meshing-disengaging control can be easily realized by properly positioning the massage-wheel-position detector 96.

During the upward and downward shifts of the movable unit 50, the guide discs 59 and 59*a* will move slidingly along the inner surfaces of the two leg parts 43 and 43*a* of the guide rail 42, the roller 62 pivoted to the guide plates 61 and 61*a* will roll against the front surface of the guide rail 42, and the roller 53 pivoted to the feed nut block 51 will roll against the rear surface of the auxiliary rail 49. As a result, the movable unit 50 can be guided without any backlash and, even when a large load is applied backwardly to the movable unit 50, the driving shaft 41 and its associated members can be effectively prevented from being bent to avoid any disablement of the unit 50. When an excessively large force is applied to the movable unit 50 and the driving shaft 41 or guide rail 42 tends to bow excessively, the guide rolls 57 and 57*a* provided at both ends of the unit shaft 55 are caused to abut against the guide surfaces 56 and 56*a* on the inner surface of the rear frame 25 to stop such bowing. Further, as the torsion springs 65 and 65*a* are urging the driving gear 58 into engagement with the rack member 44, there is provided an effective measure against any backlash or the like.

Further, as the guide rail 42 is curved forward at the upper part and rearward at the lower part to be substantially similar to the back of the users, the massaging operation can be applied to the user's back without excessive or unnatural pressing. Furthermore, the cushion 31 provided between the front surface of the guide rail 42 and the user's back prevents effectively any uncomfortable feeling from being provided to the user's back at any section of the backrest part where the massaging wheels are even not present.

What is claimed as our invention is:

1. A rocking massage chair comprising:

a rocking chair body including integral seating and backrest parts, and a rocking base having a flat bottom part disposed below said seating part and an arcuate bottom part extending upwardly from a rear end of said flat bottom part;

at least one pair of horizontally spaced, rotary massaging wheel elements housed within said backrest part of said chair body to be vertically displaceable for providing a massaging action along the back of a user sitting on the chair; and a drive mechanism for vertically displacing said massaging wheel elements, said drive mechanism comprising:

a rotatable threaded drive shaft housed in said backrest part and extending substantially between upper and lower ends of said backrest part, a drive motor housed in said seating part forwardly of said drive shaft and having an output shaft coupled to a lower end of said drive shaft for axially rotating said drive shaft, a guide rail disposed in said backrest part forwardly of said drive shaft and extending substantially parallel to said drive shaft, said guide rail positioned between said pair of massaging wheel elements and including a wall which is curved in general conformance to the shape of a user's back as viewed in side elevation, and shifting means coupled to said massaging wheel elements and to said driveshaft for being moved vertically along said curved wall of said guide rail in response to rotation of said drive shaft to displace said massaging wheel elements vertically.

2. A massage chair according to claim 1, wherein said output shaft of said drive motor is connected to said drive shaft by means of a belt.

3. A massage chair according to claim 1, wherein said shifting means includes a feed nut mounted on said drive shaft for being shifted along said shaft responsive to said axial rotation of said shaft, and a unit shaft coupled pivotably to said feed nut and arranged to be guided along said curved wall of said guide rail, said massaging wheel elements being mounted to said unit shaft.

4. A massage chair according to claim 3, including a pair of guide plates pivotably mounted on said unit shaft, a roller rotatably mounted on said guide plates such that said guide rail is disposed between said unit shaft and said roller, and means biasing said roller toward said curved wall.

5. A massage chair according to claim 3, wherein said backrest part of said chair body includes a pair of vertical guide surfaces arranged to straddle said guide rail, said unit shaft including opposite ends abuttable against respective ones of said guide surfaces upon application of excessive load to said massaging wheel elements.

6. A massage chair according to claim 5, wherein said curved wall carries a rack member facing away from a user and extending substantially the length of the guide rail, said unit shaft being rotatable and carrying a drive gear rotatable with the unit shaft and shiftable along the axis of the unit shaft between a position of mesh with said rack member and a position out-of-mesh therewith, there being a plurality of pairs of said massaging wheel elements mounted on a plurality of radial arms, said arms being connected to said shaft for rotation therewith in said mesh position of said drive gear, and displacement means for moving said drive gear into and out of mesh with said rack member.

7. A massage chair according to claim 6, wherein said rack member includes a resilient member of a height slightly higher than the deepest level of gear teeth of the rack member.

8. A massage chair according to claim 6, wherein said displacement means comprises first means disposed at an upper end of said rack member and arranged to gradually approach said rack member for guiding said drive gear into said mesh position, and second means disposed at a lower end of said rack and arranged to extend across said rack member for guiding said drive gear into said out-of-mesh positions.

* * * * *